US010188214B2

(12) United States Patent
James

(10) Patent No.: US 10,188,214 B2
(45) Date of Patent: Jan. 29, 2019

(54) PILLOWCASE AND TRAVEL PILLOW WITH EYE-COVERING APPARATUS

(71) Applicant: Linda Bernice James, Discovery Bay, CA (US)

(72) Inventor: Linda Bernice James, Discovery Bay, CA (US)

( * ) Notice: Subject to any disclaimer, the term of this patent is extended or adjusted under 35 U.S.C. 154(b) by 278 days.

(21) Appl. No.: 15/187,156

(22) Filed: Jun. 20, 2016

(65) Prior Publication Data

US 2016/0367053 A1 Dec. 22, 2016

Related U.S. Application Data

(60) Provisional application No. 62/182,305, filed on Jun. 19, 2015.

(51) Int. Cl.
*A47C 7/38* (2006.01)
*A47G 9/02* (2006.01)

(52) U.S. Cl.
CPC ..... *A47C 7/383* (2013.01); *A47G 9/0253* (2013.01)

(58) Field of Classification Search
None
See application file for complete search history.

(56) References Cited

U.S. PATENT DOCUMENTS 5,127,117 A * 7/1992 Bridges ..... A47G 9/0253 5/490
5,390,381 A * 2/1995 Lamantia ..... A45C 3/10 190/2
2012/0210516 A1* 8/2012 Popovic ..... A47G 9/1081 5/640
2013/0227784 A1* 9/2013 Holliday ..... A47G 9/0253 5/490
2015/0257538 A1* 9/2015 MacDougall ..... B60N 2/882 297/217.1
2016/0000607 A1* 1/2016 Bamberg ..... A47G 9/1045 2/15
2016/0051431 A1* 2/2016 Staats ..... A61G 7/072 128/845

* cited by examiner

*Primary Examiner* — Sarah B McPartlin
(74) *Attorney, Agent, or Firm* — Arthur Jacob

(57) ABSTRACT

The present invention is generally related to pillowcases and travel pillows, and more particularly related to one or more embodiments of a pillow wherein the pillowcase (or the travel pillow itself) includes an attached and adjustable eye-covering apparatus for improving a user's sleep by blocking ambient light from reaching the user's eye while the user is utilizing the herein disclosed pillow.

11 Claims, 3 Drawing Sheets

PILLOWCASE AND TRAVEL PILLOW WITH EYE-COVERING APPARATUS

CROSS-REFERENCES TO RELATED APPLICATIONS

This non-provisional utility application takes priority to the previously filed provisional application: Application No. 62/182,305, filed 19 Jun. 2015, which is hereby incorporated in its entirety by reference.

BRIEF DESCRIPTION OF THE INVENTION

The present invention is generally related to pillowcases and travel pillows, and more particularly related to one or more embodiments of a pillow wherein the pillowcase (or the travel pillow itself) includes an attached and adjustable eye-covering apparatus for improving a user's sleep by blocking ambient light from reaching the user's eye while the user is utilizing the herein disclosed pillow.

STATEMENTS AS TO THE RIGHTS TO INVENTIONS MADE UNDER FEDERALLY SPONSORED RESEARCH OR DEVELOPMENT

Not applicable.

REFERENCE TO A "SEQUENCE LISTING," A TABLE, OR A COMPUTER PROGRAM LISTING APPENDIX SUBMITTED ON A COMPACT DISK

Not applicable.

BACKGROUND OF THE INVENTION

The present invention is generally related to pillowcases and travel pillows, and more particularly related to one or more embodiments of a pillow wherein the pillowcase (or the travel pillow itself) includes an adjustable eye-covering apparatus for improving a user's sleep by blocking ambient light from reaching the user's eye while the user is utilizing the herein disclosed pillow.

Full and restful sleep is necessary in order to achieve a full and productive waking period. But individuals often cannot sleep fully and restfully because of the ambient light in their sleeping quarters. This ambient light can affect individuals, even when the individual is closing his or her eyes, and can cause less than ideal sleep. Persons who suffer from migraine headaches can be particularly sensitive to ambient light. Ideally, of course, a person should sleep in complete blackness so that no ambient light affects the sleep cycle. But this is not always possible due to a number of possible factors, such as persistent city lights, overnight travel situations, daytime sleep schedules, housemates on conflicting sleep schedules, etc.

Devices and modified pillows have been disclosed that attempt to solve the above described ambient light sleep interference problem. U.S. Patent Application No. 2016/0120253 to Schenk ("Schenk") discloses a head encircling sensory deprivation pillow that includes an elongated pillow that wraps completely around a user's head to block any light from entering the user's eyes. The Schenk device does block light from reaching the user's eyes, but it also purports to block sound from reaching the user's ears and as such must tightly wrap around the user's head. Such a tight wrapping around the user's head is very restrictive, puts significant pressure on the user's eyelids (calling into question the ability of a user to actually achieve restful sleep while wearing the Schenk device) and is disorienting and dangerous for the user in that sound is also blocked and therefore any dangers present in the user's room, home, and/or sleeping quarters would go completely undetected. The Schenk device differs from the herein disclosed pillow in that the Schenk device wraps tightly around a user's head thereby causing uncomfortable pressure on the user's eyes, and the Schenk device cannot be used with a traditional pillow, while the present invention can be fitted onto a traditional pillow.

Another similar device is disclosed in U.S. Patent Application No. 2008/0216244 to Minton ("Minton"). Minton discloses another sleep pillow that wraps tightly and completely around the user's head to block both light and sound. Again, this device differs from the herein disclosed pillow in that the Minton device cannot be used with a traditional pillow and the Minton device blocks sound.

Other pillow devices have been disclosed that attempt to alleviate problems associated with sleeping while traveling. One such device, disclosed in U.S. Patent Application No. 2013/0125312 to Harooni ("Harooni"), combines a traditional travel neck pillow with a traditional hood of the type usually associated with hooded, or hoodie, sweatshirts. This Harooni device may block noise and provide some relief for a sleeping traveler, but it does not block light effectively from the user's eyes and cannot be used with a traditional pillow (of standard home size or of smaller travel or airplane size). Another such device, disclosed in U.S. Patent Application No. 2013/0117939 to Moss ("Moss"), discloses a small pillow with an attached strap. The strap of Moss is intended to be used for securing the pillow to the user's wrist, or arm. This strap differs from the present invention in that it is not intended for covering the user's eyes, but instead it is intended for allowing the user to slip his or her hand through the device to securely hold the pillow during travel sleep use.

As disclosed, the prior art solutions solve the above described ambient light sleep interference problem in very different ways than the present invention; they are impractical in that they wrap tightly around a user's head and thereby impart pressure on the user's eyelids, and they are dangerous in that in addition to blocking light they also block sound and thereby render the user completely unaware of any dangers present in the sleeping quarters. Furthermore, the prior art device cannot be utilized effectively with standard pillows. There is, therefore, a need for a simpler apparatus for blocking ambient light from a user attempting to sleep. The present invention solves this problem in a simple, elegant, and inexpensive way, allowing the present invention to be widely utilized with standard household pillows and standard airplane-sized (or train/bus-sized) travel pillows. The herein disclosed pillowcase and travel pillow with eye-covering apparatus may be used with standard or traditional pillows to provide darkened sleeping conditions despite ambient light, improving sleep for travelers, persons on daytime sleep schedules, persons taking a daytime nap, and migraine suffers (sleeping in darkened conditions can decrease instances of migraine headaches). The ambient light blocking benefits of the herein disclosed pillowcase and travel pillow with eye-covering apparatus may be additionally utilized for meditation (and guided meditation) and yoga in order to help a user block out or avoid distractions.

DETAILED DESCRIPTION OF THE INVENTION

Figure 1A:
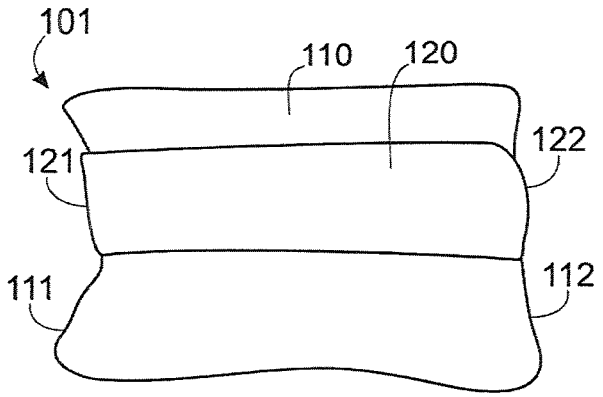
FIG. 1A illustrates a general overview of an embodiment of a pillowcase with eye-covering apparatus, in accordance with the present invention.

The present invention is, in some embodiments, a pillowcase for use with a traditional pillow wherein the pillowcase includes an eye-covering band for blocking ambient light from reaching a user's eyes. In an exemplary embodiment, the pillowcase includes a pillowcase body for enclosing a traditional pillow. The pillowcase body has an open end (for inserting the pillow) and a closed end. The eye-covering band has a first end, which may be attached to the closed end of the pillowcase body, and a second end, which may be attached to the open end of the pillowcase body. A user utilizes the herein disclosed pillowcase by putting his or her head down on the pillowcase body (and thereby down on the pillow enclosed within the pillowcase body), underneath the eye-covering band. The eye-covering band lays over the user's eyes and thereby blocks ambient light from reaching the user's eyes. In this way, the user is able to achieve improved sleeping conditions because the ambient light of the user's sleeping quarters will be blocked by the eye-covering band. The eye-covering band may be of sufficient length that it need not be pulled tight against the user's head (or against the user's eyelids). In this way, the user is able to wear the eye-covering band during sleep without restricting his or her freedom of movement during sleep. Because the eye-covering band may not be pulled tight, and because the eye-covering band may be made of a soft material such as cotton, the eye-covering band does not substantially block sound from reaching the user's ears even though the eye-covering band may be positioned over the user's ears. This allows the user to continue to be able to hear noises, such as indications of danger (a fire alarm, for example), while wearing the eye-covering band portion of the herein disclosed pillowcase.

In an alternative embodiment of the herein disclosed invention, a travel pillowcase is disclosed which includes a travel pillowcase body for enclosing an airplane pillow (or any smaller travel-sized pillow for use during sleep on a transportation vehicle, for example). The travel pillowcase may include a pillowcase body having a first end and a second end, wherein the second end has a top side and a bottom side. The travel pillowcase also includes an eye-covering band for blocking ambient light from reaching the user's eyes. The eye-covering band may include a first end and a second end. The eye-covering band may be attached to the pillowcase body at the second end: in this exemplary embodiment, the first end of the eye-covering band is attached to the top side of the pillowcase body and the second end of the eye-covering band is attached to the bottom side of the pillowcase body. A user utilizes the herein disclosed travel pillowcase by placing the eye-covering band around his or her head, so that the band is covering the user's eyes. The user then twists the eye-covering band and tucks any excess eye-covering band material between the user's face and the pillowcase body (or between the back of the user's head and the pillowcase body, if the user is sleeping on his or her back). The user then lays his or her head down on the pillowcase body, and thereby the pillow enclosed within, with the eye-covering band in position covering the user's eyes. In an alternate embodiment of the travel pillow, the pillow itself may be sewn into (or otherwise permanently positioned within) the pillowcase body so that the travel pillow plus pillowcase and eye-covering band is combined into an all-encompassing travel pillow device, or apparatus.

Figure 1B:
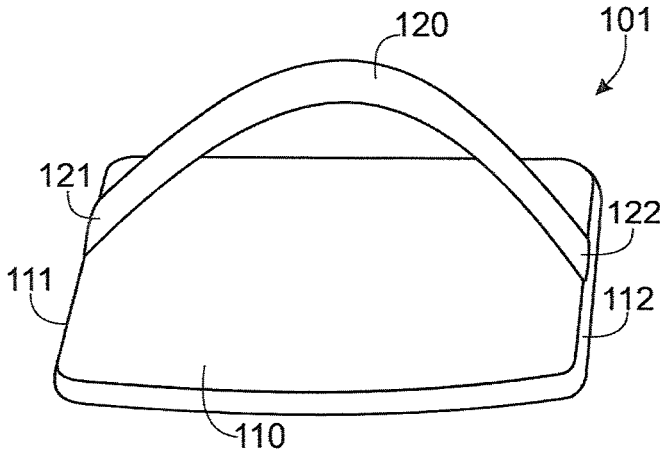
FIG. 1B illustrates a side view of an embodiment of a pillowcase with eye-covering apparatus.

Referring to FIG. 1A and FIG. 1B, the herein disclosed pillowcase with eye-covering apparatus is illustrated. FIG. 1A shows pillowcase with eye-covering apparatus 101, including pillowcase body 110 having a first end 111 and a second end 112. Pillowcase body 110 may be formed of any material suitable for a pillowcase, such as cotton for example. First end 111 of the pillowcase body (pillowcase body first end 111) may be closed, while second end 112 of the pillowcase body (pillowcase body second end 112) may be open for insertion of a pillow. Pillowcase body 110 may be of such dimensions so as to allow a traditional pillow to be inserted within. The phrase traditional pillow is intended to include a standard household pillow, a queen-size pillow, a king-size household pillow, or a slightly smaller child-sized pillow, and all other pillows which are commonly used in households worldwide. In additional, pillowcase with eye-covering apparatus 101 can be made to accommodate the larger dimensions of a body pillow (sometimes referred to as a pregnancy pillow). Pillowcase with eye-covering apparatus 101 also includes eye-covering band 120. Eye-covering band 120 may be formed of the same material used to form pillowcase body 110, or alternatively eye-covering band 120 may be formed of an opaquer material designed to block more light than the material used to form pillowcase body 110. For example, eye-covering band 120 may be a double (or triple) layer of cotton material, wherein the bottom layer laying against the user's eyes or eyelids is a formed of red, blue, or black cotton so as to block as much light as possible without sacrificing comfort.

Eye-covering band 120 includes first end 121 and second end 122. First end 121 may attach to pillowcase body 110 at pillowcase body first end 111, and second end 122 may attach to pillowcase body 110 at pillowcase body second end 112. In one exemplary embodiment, first end 121 may be attached by a secure and permanent attachment, such as stitching for example, and second end 122 may be attached by an adjustable attachment, such as a hook-and-loop fastener, for example. Those skilled in the art will recognize that other adjustable attachment means may be utilized in this embodiment, and all such adjustable attachments are intended to be included herein. In an alternative embodiment, both first end 121 and second end 122 may be attached to pillowcase body 110 by permanent attachments, such as stitching for example.

FIG. 1B shows the same embodiment of the herein disclosed pillowcase with eye-covering apparatus as FIG. 1A, except that FIG. 1B is a side-view illustrating eye-covering band 120 bulging away from pillowcase body 110 in the middle as would be the case during use. As shown in FIG. 1B, eye-covering band 120 is attached to pillowcase body 110 at first end 112 and second end 112.

Figure 2A:
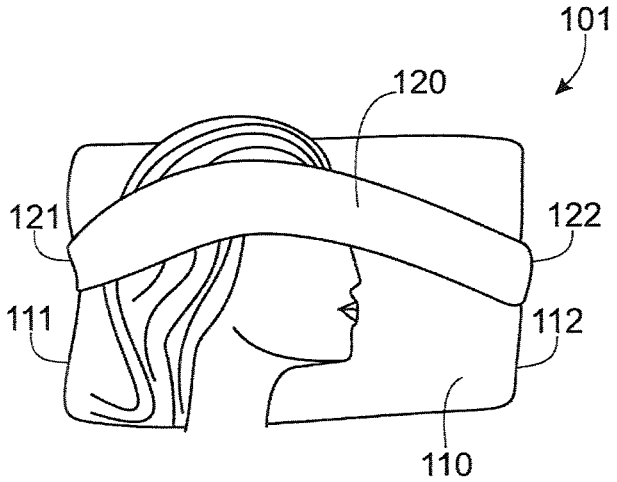
FIG. 2A illustrates an embodiment of a pillowcase with eye-covering apparatus while in use by a user sleeping on the user's side.
Figure 2B:
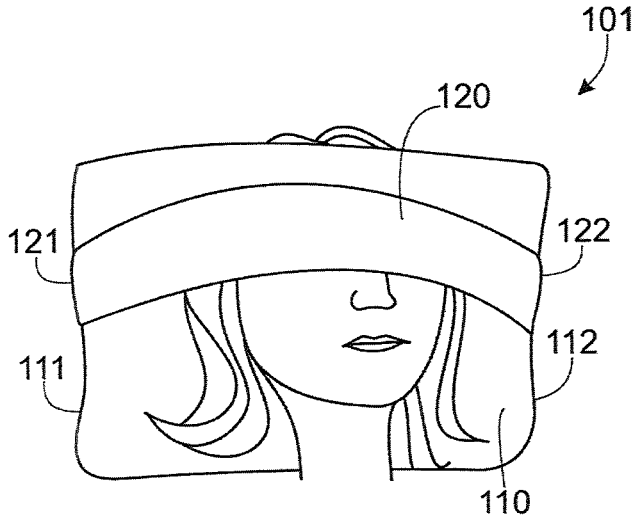
FIG. 2B illustrates an embodiment of a pillowcase with eye-covering apparatus while in use by a user sleeping on the user's back.

Referring to FIG. 2A and FIG. 2B, the herein disclosed pillowcase with eye-covering apparatus 101 is illustrated during use by a user. FIG. 2A shows a user sleeping on his or her side resting the user's head on pillowcase body 110 (and thereby resting the user's head on the pillow enclosed within pillowcase body 110) and with eye-covering band 120 covering the user's eyes so as to block ambient light. FIG. 2B shows a user sleeping on his or her back, also with eye-covering band 120 covering the user's eyes so as to block ambient light. Eye-covering band 120 is of sufficient length so as to create some slack during use. In this way, the user is able to comfortably adjust his or her sleep position during use without feeling restricted (as a feeling of restriction is likely to wake up the user—something which the present invention avoids). This may be referred to as providing the user with freedom of movement during sleep.

In one exemplary embodiment, wherein eye-covering band first end 121 is attached by a permanent attachment to pillowcase body first end 111 and eye-covering band second end 122 is attached by an adjustable attachment (such as a hook-and-loop fastener, for example), the user is able to adjust an effective length of eye-covering band 120 by adjusting the placement of second end 122 on pillowcase body second end 112. This way the user can ensure that eye-covering band 120 has enough slack so as to allow freedom of movement during sleep. In an alternative embodiment, wherein both eye-covering band first end 121 is attached by a permanent attachment to pillowcase body first end 111 and eye-covering band second end 122 is attached by a permanent attachment to pillowcase body first end 112, an effective length of eye-covering band 120 may also be adjustable by the user choosing a desired effective length of eye-covering band 120 and tucking the remaining portion (beyond the effective length) between the user's head and pillow with eye-covering apparatus 101 during use. Thus, in several alternative embodiments, the user may be provided with freedom of movement during sleep.

Figure 3A:
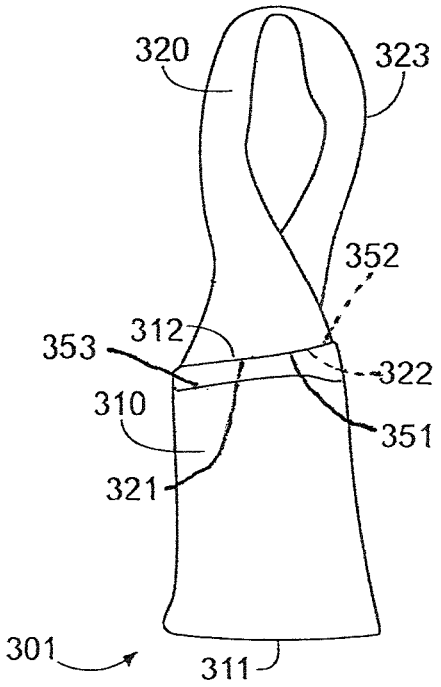
FIG. 3A illustrates a general overview of an embodiment of a travel pillowcase with eye-covering apparatus, in accordance with the present invention.
Figure 3B:
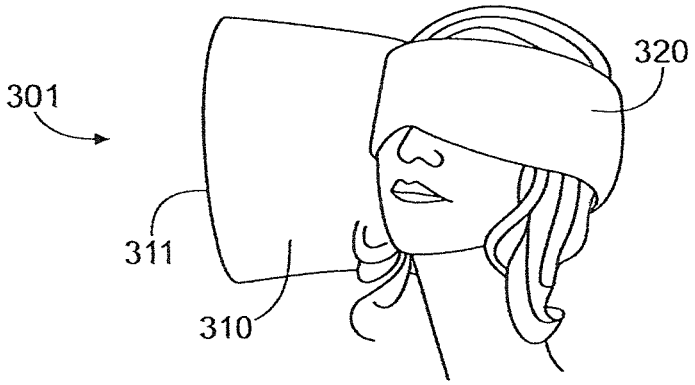
FIG. 3B illustrates an embodiment of a travel pillowcase with eye-covering apparatus while in use by a user.

Referring to FIG. 3A and FIG. 3B, a travel embodiment of the present invention is illustrated. FIG. 3A show travel pillowcase with eye-covering band 301, including pillowcase body 310 having first end 311 (pillowcase body first end 311) and second end 312 (pillowcase body second end 312). Second end 312 includes top side 351 and bottom side 352. Travel pillowcase with eye-covering band 301 also includes eye-covering band 320, wherein eye-covering band 320 has first eye-covering band end 321 and second eye-covering band end 322. First eye-covering band end 321 attaches (permanently with stitching, for example) to pillowcase body 310 at top side 351, at second end 312, and second eye-covering band end 322 attaches (permanently with stitching, for example) to pillowcase body 310 at bottom side 352, also at second end 312, in juxtaposition with first eye-covering band end 321, thereby establishing a closed loop 323. FIG. 3B illustrates travel pillowcase with eye-covering band 301 in use by a user, and shown looped over the eyes of the user.

Pillowcase body 310 is of a size to allow insertion of a smaller travel-sized pillow. The phrase smaller travel-sized pillow is intended to include standard rectangular airplane pillows, which are usually 12 inches by 14 inches, as well as similar pillows provided by trains, buses, limousines, etc. and other smaller rectangular pillows marketed as being for use during travel.

In an alternative embodiment of the present invention, a smaller travel-sized pillow may be permanently enclosed (by stitching, for example) within pillowcase body 310. In this way, the entire apparatus (pillowcase body 310, eye-covering band 320, and a smaller travel-sized pillow) may be combined into one device or apparatus for sale and use as a singular unit. In such an embodiment, a standard travel pillow may be permanently sewn into pillowcase body 310. Alternatively, pillowcase body 310 may be filled with a material (such as polyester cluster fiber fill, for example) that acts as a travel pillow for the combination. The entire combined apparatus may be washable in this embodiment.

In another alternative embodiment, pillowcase body 310 may include an additional layer (on its front side or its back side) of fabric or material that creates a pouch 353 for storage of the eye-covering band 320 when the travel pillow (or travel pillowcase) is not in use. In this embodiment, a user may tuck the entire eye-covering band into the pouch 353, thus minimizing the total size of travel pillowcase with eye-covering band 301 when not in use.

While the present invention has been illustrated and described herein in terms of a preferred embodiment and several alternatives, it is to be understood that the apparatus described herein can have a multitude of additional uses and applications. Accordingly, the invention should not be limited to just the particular description and various drawing figures contained in this specification that merely illustrate a preferred embodiment and application of the principles of the invention.

What is claimed is:

1. A travel pillowcase, comprising:

a pillowcase body for enclosing a smaller travel-sized pillow, the pillowcase body including a first pillowcase body end and a second pillowcase body end, wherein the second pillowcase body end has a top side and a bottom side; and an eye-covering band dimensioned for blocking ambient light from reaching a user's eyes, the eye-covering band including a length between a first eye-covering band end and a second eye-covering band end, enabling selective adjustment of the eye-covering band for comfort, wherein the first eye-covering band end is attached to the top side of the second pillowcase body end and the second eye-covering band end is attached to the bottom side of the second pillowcase body end, in juxtaposition with the first eye-covering band end.

2. The travel pillowcase as recited in claim 1, wherein the first eye-covering band end is attached to the top side of the second pillowcase body end by stitching, and wherein the second eye-covering band end is attached to the bottom side of the second pillowcase body end by hook-and-loop fasteners.

3. The travel pillowcase as recited in claim 1, wherein the first eye-covering band end is attached to the top side of the second pillowcase body end by stitching, and wherein the second eye-covering band end is attached to the bottom side of the second pillowcase body end by stitching.

4. The travel pillowcase as recited in claim 1, wherein the eye-covering band is of sufficient length so as to allow the user freedom of movement during sleep.

5. The travel pillowcase as recited in claim 1, wherein the eye-covering band is dimensioned to not block sound from reaching the user.

6. The travel pillowcase as recited in claim 1, wherein the pillowcase body includes an additional layer of material creating a pouch for storage of the eye-covering band when not in use.

7. The pillowcase as recited in claim 1, wherein the pillowcase body includes a pouch for storage of the eye-covering band when not in use.

8. A travel pillow, comprising:

a pillow including a first pillow end and a second pillow end, wherein the second pillow end has a top side and a bottom side; and an eye-covering band dimensioned for blocking ambient light from reaching a user's eyes, the eye-covering band including a length between a first eye-covering band end and a second eye-covering band end, enabling selective adjustment of the eye-covering band for comfort, wherein the first eye-covering band end is attached to the top side of the second pillow end and the second eye-covering band end is attached to the bottom side of the second pillow end in juxtaposition with the first eye-covering band end.

9. The travel pillow as recited in claim 8, wherein the pillow is filled with polyester cluster fiber fill material.

10. The travel pillow as recited in claim 8, wherein the pillow includes an additional layer of material creating a pouch for storage of the eye-covering band when not in use.

11. The travel pillow as recited in claim 8, wherein the pillow includes a pouch for storage of the eye-covering band when not in use.

* * * * *